United States Patent [19]

Frederick

[11] 4,330,412

[45] May 18, 1982

[54] HYDROTHERAPY DEVICE, METHOD AND APPARATUS

[75] Inventor: Stanley H. Frederick, Ramsey, N.J.

[73] Assignee: International Telephone and Telegraph Corporation, New York, N.Y.

[21] Appl. No.: 812,864

[22] Filed: Jul. 5, 1977

[51] Int. Cl.[3] ..... E04H 3/20

[52] U.S. Cl. ..... 210/805; 4/492; 210/169; 210/416.2

[58] Field of Search ..... 128/66, 365, 369; 4/172.17, 172.16, 172, 178, 180; 210/169, 83, 416 AS, 805; 417/432; 318/224 A

[56] References Cited

U.S. PATENT DOCUMENTS

| | | | |
|---|---|---|---|
| 3,316,937 | 5/1967 | Friedman et al. | 137/625.29 |
| 3,504,795 | 4/1970 | Johnson | 210/83 |
| 3,584,980 | 6/1971 | Cawley | 417/432 |
| 3,588,649 | 6/1971 | Heine et al. | 318/224 A |
| 3,786,921 | 1/1974 | Johnson | 210/130 |
| 3,801,992 | 4/1974 | Sable | 4/172.17 |
| 3,828,932 | 8/1974 | Schneer | 210/169 |
| 3,943,580 | 3/1976 | Carter | 210/169 |
| 3,988,787 | 11/1976 | Colee | 4/172.17 |
| 4,001,899 | 1/1977 | Mathis | 4/172.16 |
| 4,019,210 | 4/1977 | Patterson et al. | 4/172 |
| 4,030,009 | 6/1977 | Halstern | 318/224 A |

*Primary Examiner*—Theodore A. Granger

*Attorney, Agent, or Firm*—John T. O'Halloran; Peter C. Van Der Sluys

[57] ABSTRACT

A hydrotherapy device, such as a spa, whirlpool or jet stream exerciser is connected to a closed water circulation loop having a drain, a pump, a heater, a filter, a valve controlled filter bypass and injection nozzles. The pump is equipped with a close-coupled drive motor having two sets of stator windings for allowing the selection of one of two motor speeds to achieve improved operation and greater efficiency of the hydrotherapy device. A low motor speed is selected during periods of non-use, at which time the filter device is connected into the circulation loop so that a low water circulation rate is provided in order to maintain purity of the water. During periods of use, a higher motor speed is selected and the filter is bypassed to provide a high water circulation rate and high velocity water injection into the hydrotherapy device. Reduced motor speed during periods of non-use results in substantial energy savings and a reduction in the noise generated by the device.

11 Claims, 8 Drawing Figures

HYDROTHERAPY DEVICE, METHOD AND APPARATUS

BACKGROUND OF THE INVENTION

1. Field of the Invention

The present invention relates to hydrotherapy devices and, more particularly, to such devices having selectable water circulation rates.

2. Description of the Prior Art

Hydrotherapy devices, such as health spas, whirlpool and jet stream exercisers, are becoming popular and are being installed in health and athletic clubs and in residential homes at an increasing rate. Two problems have been experienced with existing devices, namely the increased cost in maintaining purity of the water due to the high energy cost of operating the filter system and the noise generated by the filter system. The noise is particularly obnoxious in residential installations during evening hours.

Several actions have been taken in an attempt to overcome these difficulties, the most common procedure is to turn off the pump during periods of non-use and especially during the evening hours. This procedure eliminates the nighttime noise and reduces the overall energy consumption; however, the pollutant levels in the system quickly rise to unacceptable levels providing dangerous health hazards. In order to eliminate the health hazard, it is essential that the filter system remain in operation continuously so that the water continues to circulate, thereby preventing stagnation and the proliferation of impurities.

In an attempt to reduce energy consumption while maintaining water purity, users periodically turned the filter system on and off at specified intervals; however, this starting and stopping of the pump motor was extremely detrimental to the motor and severely reduced the life thereof.

Thus, there is a significant need in the industry for a device that is more efficient and generates less noise while still providing a sufficient flow rate to realize the beneficial effects of the hydrotherapy device.

SUMMARY OF THE INVENTION

The present invention provides a unique solution to the energy consumption and noise problems of the prior art devices by utilizing a two-speed close-coupled motor with a centrifugal pump to circulate the water through the device. The use of a two-speed centrifugal pump in conjunction with water filters has been rejected by the industry because of their apparent failure to fully understand the significance of system head curves. The industry was pre-occupied with the problems of increased pressure drop, $\Delta$ H shown in FIG. 5, across the filter as it became dirty and the need for sufficient capacity to overcome this drop, that it failed to realize that during periods of non-use, a much lower pump capacity could be satisfactorily used with substantial energy savings and the accompanying reduction in noise level. It was a common misconception that flow rate is controlled solely by pump pressure and therefore low capacity pumps could not be used since a slight rise in filter pressure drop would quickly exceed the shut-off head of the pump, resulting in a zero flow.

Referring to FIG. 1, there is shown a series of system head curves resulting from increased filter resistance. The graph of FIG. 1 shows curves for a system having total head H plotted against resulting capacity or flow rate Q. The solid line labeled "Total Circulation System Head" represents the total system curve, taking into account the entire circulation system resistance including a clean filter, heater, piping, valves, elbows and nozzles. The static suction lift is not reflected in the curve. The dashed lines show the effect of increased filter resistance on the system head curve.

FIG. 1 also shows the typical operating characteristics of a centrifugal pump, and the curve is labeled $H.Q._{Hi}$. The system performance may be evaluated by comparing the $H.Q._{Hi}$ curve and the system head curves. With a clean filter, a head of about 21 feet would result in a flow of about 88 gallons per minute; however, with a dirty filter, a head of 54 feet develops a flow rate of about 25 gallons per minute. Thus, the filter itself can result in increased pressure drop of over 33 feet, shown on FIG. 1 as $\Delta H_{Hi}$.

As a result of this increased pressure drop across the filter, prior art designers have considered it essential that the pump operating characteristics provide sufficient head to overcome this pressure drop. Thus, a pump providing a pressure head of less than 33 feet would be unacceptable in such a system since it would not be able to handle the pressure drop of a dirty filter and the flow would shut off.

Also shown on FIG. 1 is the operating characteristics of a centrifugal pump operating at a low speed indicated as $H.Q._{Lo}$, and it can be readily seen that the maximum head developed at the low speed is about 16 feet and would thus, according to prior art designers, be unacceptable in the system.

What the prior art designers failed to take into consideration were the system head curves which, when considered, show that the pressure drop across the filter is not 33 feet as it was for the high speed operation but is considerably reduced and is approximately 10 feet, shown as $\Delta H_{Lo}$ in FIG. 1. Thus, the applicant has discovered that a centrifugal pump operating at a low speed may provide sufficient flow to maintain water purity while using considerably less energy and generating significantly lower noise levels. During periods when the device is to be used, the pump is operated at a high speed to provide the necessary flow rate to realize the therapeutic value of the device.

The applicant has also increased the flow rate and improved the operation by providing a valve controlled filter bypass so that the filter resistance is eliminated from the circuit and significantly greater flow rates may be achieved. It is perfectly permissible to eliminate the filter from the circuit during periods of use since the impurities introduced into the water from the human body during use will be adequately removed during the longer periods of non-use experienced in residential installations.

Thus, the present invention contemplates a hydrotherapy device having a two-speed pump motor that provides high capacity for high water flow rates during periods of use of the device, while providing a lower circulation rate during periods of non-use. The circulation rate is sufficient to prevent the water from becoming stagnant with the resulting proliferation of impurities while providing a considerable savings in energy costs. The lower circulation rate also results in the unexpected benefit of a substantial reduction in noise levels.

Two-speed and variable speed motors are rather common, and the method of achieving the variable speed is usually dependent upon the use to which the motor is applied. Variable speed may be obtained through the use of a variac while dual speed may be achieved through the use of a rectifier device. Both of these means of providing speed changes consume energy and are thus inefficient methods of providing speed control and could not be considered for use in an efficient energy saving filter system.

The present invention contemplates the use of a motor wherein the two-speed capability is achieved by the efficient use of two separate stator windings for two-pole or four-pole operation to achieve nominal motor speeds of 3500 RPM and 1750 RPM. The motor is provided with a manual selector switch by which the motor may be operated at low or high speed.

The primary objective of the present invention is to provide a more efficient circulating system for a hydrotherapy device.

Another objective of the present invention is to provide a circulating system for a hydrotherapy device that generates less noise than those devices heretofore provided.

Another objective of the present invention is to provide a circulating system for a hydrotherapy device wherein a low flow rate is used during periods of non-use for filtering purposes while a high flow rate is used during periods of use so that the therapeutic value of the device is increased.

These and other objectives and advantages of the invention will become more apparent from the following description, taken in conjunction with the accompanying drawings wherein several embodiments of the invention are described.

DESCRIPTION OF THE INVENTION

Figure 2:
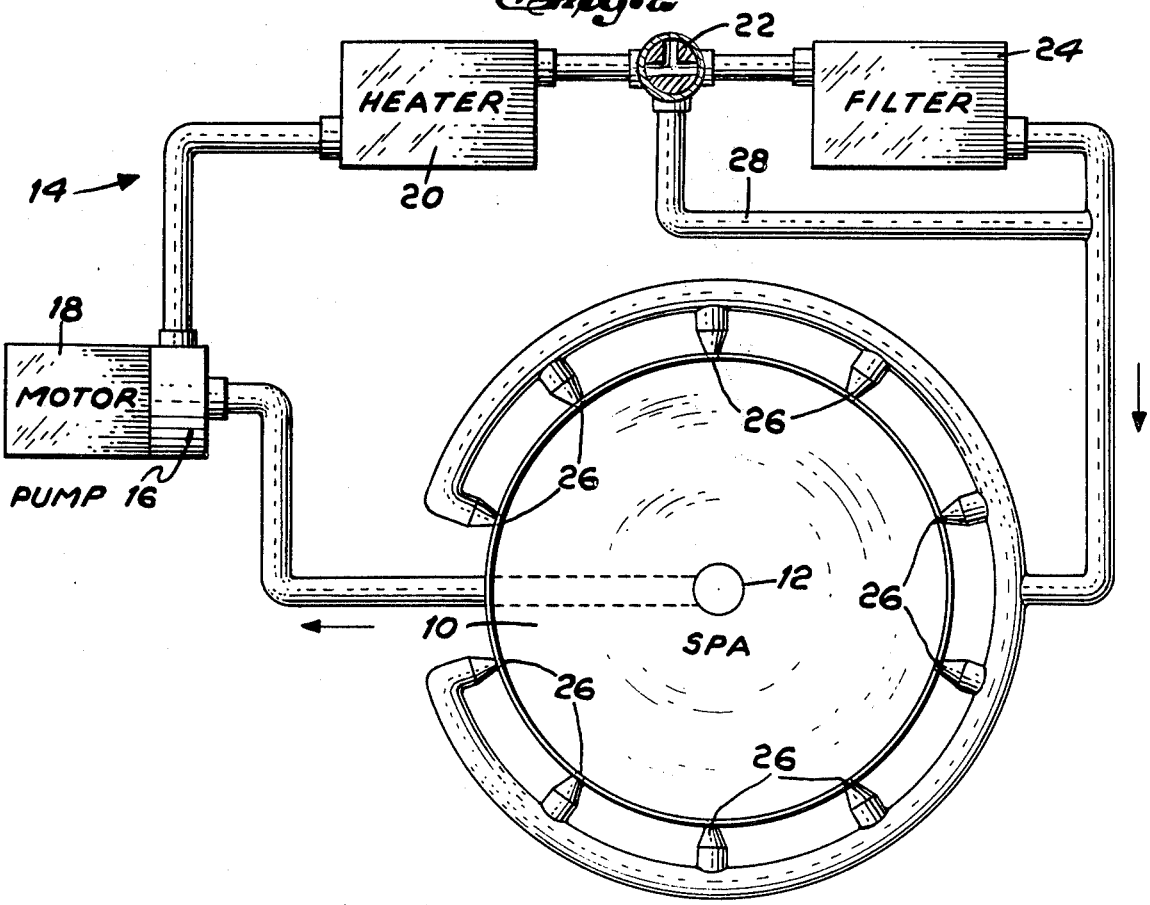
FIG. 2 is a schematic representation showing the present invention in the form of a health spa.

Referring to FIG. 2, there is shown a spa 10 having an outlet 12 for connection to a circulating system 14. The spa may be a circular bath that contains a quantity of water; however, it is to be understood that the size and shape are not pertinent to the present invention and may vary considerably depending upon the facility in which it is used, such as a home or a health club. Outlet 12 is connected to an inlet of a centrifugal pump 16 which is coupled to a motor 18. Preferably, pump 16 and motor 18 are close-coupled as an integral unit on a single shaft. The motor and pump combination may be similar to that used on the Mar Dur Model 1½ HP21EC-A3 swimming pool pump sold by ITT Marlow, the assignee of the present invention. The pump has an outlet connected to an inlet of a heater 20 for heating the circulating water. An outlet of heater 20 is connected by way of a valve 22 to a filter 24. An outlet of filter 24 is connected to a plurality of nozzles 26 disposed about the periphery of the spa 10 and positioned to inject high speed water into the spa. A bypass 28 is connected from valve 22 to the outlet of filter 24 so that the filter may be bypassed during use of the spa.

It is often considered desirable to introduce air into the injected water to provide a frothing and bubbling action. This can be accomplished in a number of ways. A venturi can be provided at the nozzles for drawing air into the water; however, this type of apparatus is rather noisy and inefficient due to the severe pressure drops through the venturi. It is also possible to inject pressurized air directly into the water through ports at the bottom or sides of the spa.

Figure 3:
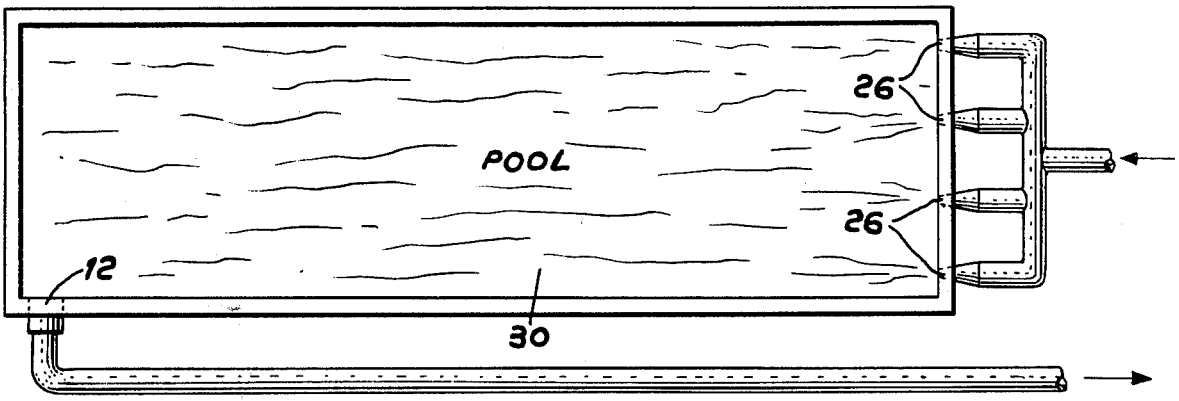
FIG. 3 is a schematic representation of another embodiment of the present invention in the form of a jet stream pool exerciser.

It is also contemplated that the present invention may be used in a jet stream swimming exerciser as shown in FIG. 3 wherein a small pool of water 30 usually of rectangular shape has water injected into one end by a plurality of nozzles 26, the water being drained from the opposite end of the pool by drain 12. The drain 12 is connected to the input of centrifugal pump 16 and the nozzles 26 are connected to the output of the filter 24 and the bypass 28 shown in FIG. 2. The water injected from the nozzles 26 sets up a current in the pool 30 against which a person may swim for the purpose of exercise. The pool itself should be as small as possible, so that a minimum amount of water is required, but large enough to provide sufficient room for a swimmer to move about freely.

Figure 4:
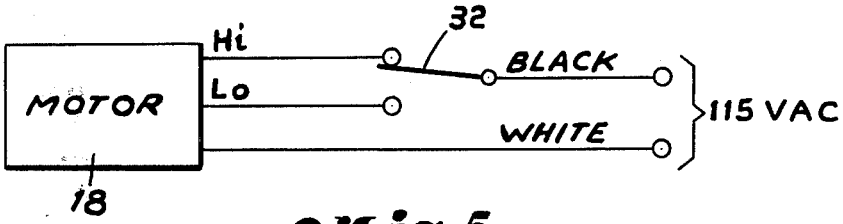
FIGS. 4 and 5 are schematic diagrams of a portion of the electrical control system of the present invention.

The motor 18 used in the present invention is a two-speed motor having nominal speeds of 1750 RPM and 3500 RPM. The two-speed feature of the motor is preferably achieved through the use of a dual stator winding wound to selectively provide two-pole and four-pole operation. By using the dual stator windings, a more favorable energy efficiency is achieved by the motor as compared with other speed varying means, such as rectifiers or variacs. The motor for residential use will usually be in the size range of ⅓ to 2 horsepower, which is generally considered sufficient to provide proper circulation rates for residential type hydrotherapy devices. It is to be understood that larger size motors may be used when larger bodies of water are required, such as for health and athletic clubs. The motor may be designed for either 115 or 230 volt AC operation and in the least complex embodiment shown in FIG. 4, the motor is equipped with a manually operated switch 32 which may be a single pole double-throw toggle switch. When the switch is moved to one side, the high speed winding is energized while in the other position the low speed winding is energized.

Figure 5:
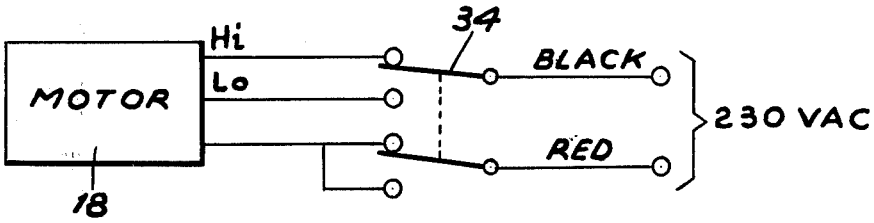

Referring to FIG. 5, there is shown a preferred circuit arrangement for a 230 volt AC motor which requires that both power lines be controlled by the switch. Thus, a double pole, double-throw switch 34 may be used to control both power lines of the 230 volt energy source.

It is contemplated that the embodiments shown in FIGS. 2 and 3 will be operated at a low motor speed during periods of non-use, with the valve 22 positioned as shown in FIG. 2 so that the water is slowly circulated through the filter 24 to maintain water purity. During periods of non-use, the heater 20 which may be an electric or gas-fired heater will most likely be shut off to conserve energy. It is not necessary that the heater be on full time because the small volume of water contained in the spa 10 or pool 30 may be quickly warmed up by heater 20 just prior to use and therefore, it is not necessary to maintain an elevated water temperature during the substantial periods of non-use. Due to the small volume of water, the flow rate during periods of non-use may be minimal since filtration will not generally be a big problem and the water will be frequently circulated through the filter.

When a person desires to use the spa or the pool, the valve 22 will be turned to a position wherein the water flows through bypass 28. In this position of the valve, the restriction provided by filter 24 is eliminated from the circulation loop and a substantially greater flow rate results. The motor 18 will also be switched to its high speed operation and the heater 20 will be energized. By switching the motor to the high speed and by bypassing filter 24, substantially increased flow rates may be experienced and the water injected by the nozzles 26 will be at a high velocity, thereby providing the necessary therapeutic value in the spa 10 and providing a substantial current in the pool 30.

Figure 6:
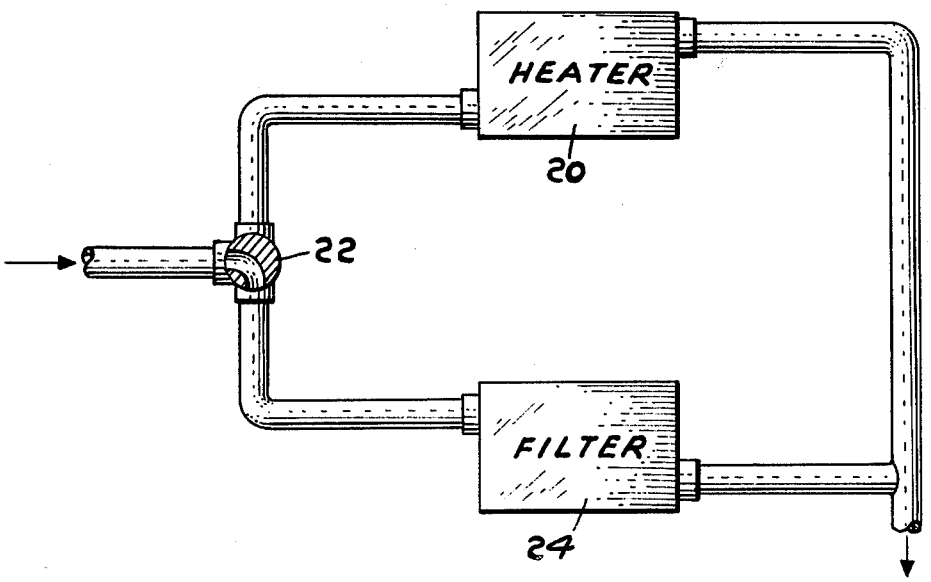
FIG. 6 shows an alternate embodiment for the filter and heater connection.

Referring to FIG. 6, there is shown an alternate embodiment for the connection of the heater 20 and the filter 24. Heater 20 and filter 24 are connected in parallel with the valve 22 arranged so that the incoming water may be directed to either the filter or the heater. During periods of non-use, valve 22 will be positioned as shown in FIG. 6 so that the water flows through the filter 24 and bypasses heater 20. When the device is to be used, the valve 22 is positioned to direct the incoming water through the heater 20 and to bypass filter 24.

Figure 1:
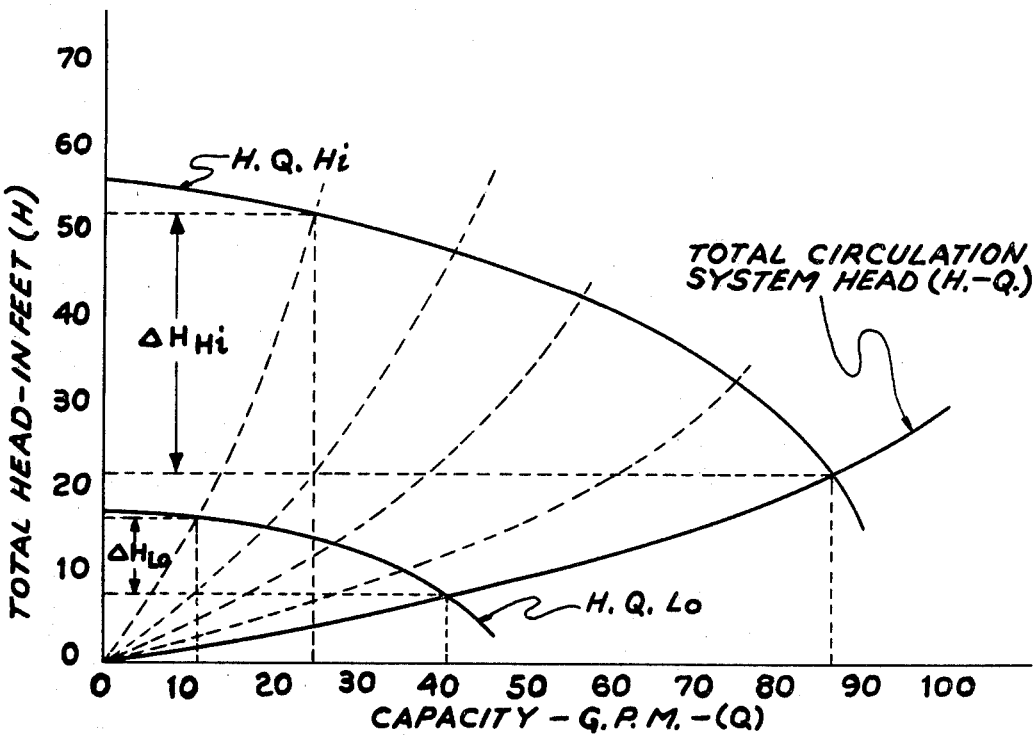
FIG. 1 is a graph showing the operational characteristics of a typical circulating system that includes a filter and a centrifugal circulating pump.
Figure 7:
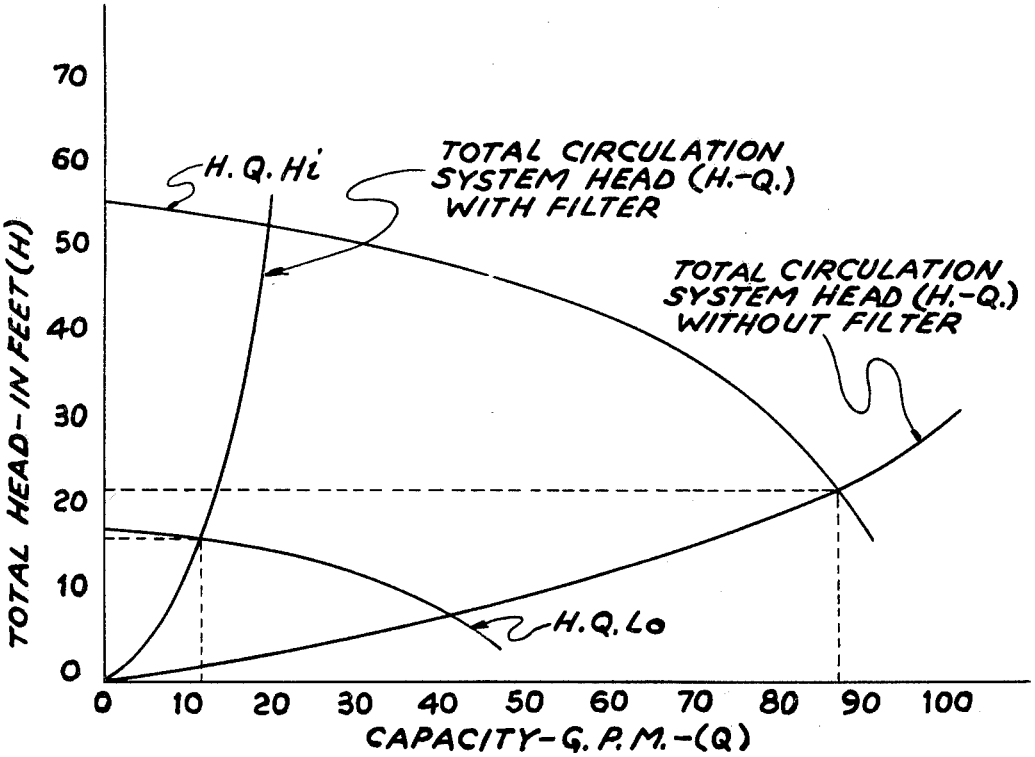
FIG. 7 is a graph showing the operational characteristics of a system incorporating the present invention.

For a better understanding of how the substantial increases in flow rate may be achieved by merely changing the motor speed by a factor of two and by eliminating the filter, reference should be made to FIG. 7 where the pump characteristics are superimposed on the total circulation system head curves for the system with and without the filter. The particular pump motor used was a nominal NSF rated one horsepower motor. The graph shows the flow curves $H.Q._{Hi}$ for 3500 RPM and $H.Q._{Lo}$ for 1750 RPM operation by plotting flow rate (Q) in gallons per minute against total head (H) in feet. Superimposed on the curve is the total circulation system head curve representing the system head curve without the filter and a total circulation system head curve with the filter. The curves are similar to two of the system head curves shown in FIG. 1 and discussed previously. It can be seen that without the filter, the system head curve has a very gentle slope and extends a considerable distance before it intercepts the flow curve $H.Q._{Hi}$ for the 3500 RPM operation whereas the system head curve with the filter has a very steep slope and quickly intercepts the $H.Q._{Lo}$ curve for the low speed operation. Thus, it can be seen that with the high speed operation and the filter out of the circulating system, a flow rate of approximately 90 gallons per minute may be achieved, while at the low speed motor operation and with the filter in the system, a flow rate of approximately ten gallons per minute is achieved. Thus, it can be seen how the substantial change in the flow rate may be achieved through the unique use of a two-speed motor pump in combination with a filter bypass during the high speed operation.

Figure 8:
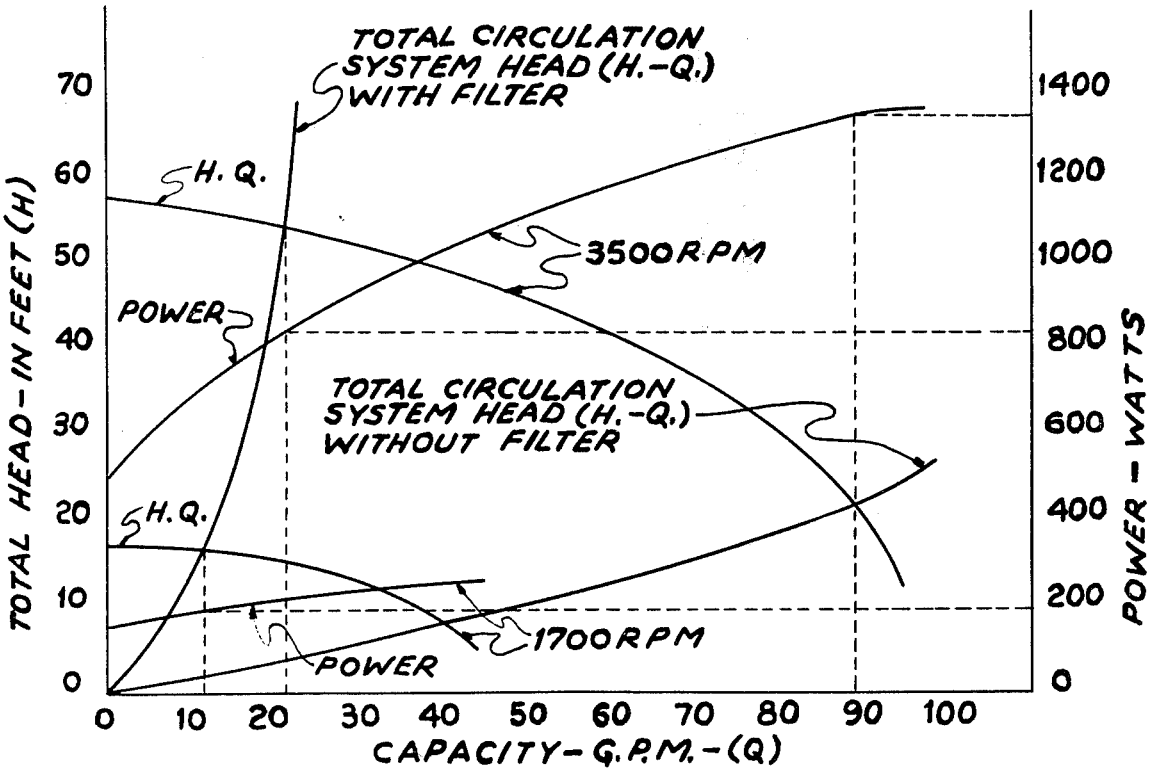
FIG. 8 is a graph showing the operational characteristics including power consumption of a system utilizing the present invention.

In order to more fully appreciate the benefits of the present invention, reference should be made to FIG. 8 where the power curves for the motor are superimposed over the curves shown in FIG. 7. The power curves show energy consumed at each operating speed in watts plotted against flow rate in gallons per minute. Thus, at a nominal motor speed of 3500 RPM, a flow rate of 90 gallons per minute is achieved with an energy consumption of approximately 1,350 watts. At a nominal 1750 RPM speed, a flow rate of ten gallons per minute is achieved with an energy consumption of less than 200 watts. Thus, it is apparent that by operating at the lower flow rate, the energy consumed is reduced substantially. For example, if the pump were to continue running at the nominal 3500 RPM speed with the filter in the system, a flow rate of approximately 22 gallons per minute would be realized with a power consumption of over 800 watts. Thus, by operating at the low speed during periods of non-use, the energy consumption is reduced to less than one-fourth that of the high speed with the filter. Comparable results may be achieved with similar systems having motors of different sizes.

When one considers that a residential spa would probably be used at the most one hour a day and that it may run at low speed during the remaining 23 hours, during which time 600 less watts of power will be consumed, it is apparent that considerable savings may be realized over a period of time. At a cost per kilowatt hour of six cents, the savings during a thirty-day month would be almost $25.00. Considering that the cost of energy is increasing, this savings will, in all likelihood, increase.

Another important unexpected advantage realized by the present invention is the substantial reduction in noise that is achieved by operating at the lower speed. This advantage is particularly important in residential installations where the constant drone of the motor and pump becomes quite annoying during the evening hours when one is trying to sleep.

Test results indicated that at the low speed operation, there was a 68% reduction in noise level as compared with the high speed operation. These tests were conducted under ideal conditions with no noise reflective surfaces so that the motor noise was dissipated about a full 360° without the production of any echoes. It is to be expected that in a home, the noise will resonate through the building and piping system as is commonly experienced with hot water hydronic heating systems. Thus, it is apparent that the reduction in noise is a significant advantage of the present invention.

From the foregoing, it is apparent that the present invention provides improved operating characteristics for a hydrotherapy device, while also providing more efficient and quieter operation. Substantial reductions in energy consumption may be realized while maintaining the water purity and eliminating the risks of high contamination levels that may result when the circulation system is shut down. In addition to the above mentioned beneficial results, the present invention also provides the unexpected advantage of significantly reduced levels of noise pollution.

What is claimed is:

1. A hydrotherapy device, comprising:

water retaining means for retaining a body of water, said means having an outlet and a plurality of inlets;

injecting means associated with each of said inlets for injecting water into the body of water at a high velocity;

a water circulating and purifying system including a centrifugal liquid pump and a filter serially connected between the outlet of the water retaining means and the injection means;

a motor capable of operating at at least two speeds drivably connected to said pump;

means for selecting one of said two motor speeds whereby a high water circulation rate may be selected when the hydrotherapy device is to be used and a low water circulation rate may be selected during periods of non-use so that the water may be filtered at an energy saving low circulation rate; and means associated with said circulation system for selectively bypassing the filter during periods of use and high water circulation rates to thereby cause a greater increase in the water circulation rate and improved therapeutic action.

2. A device as described in claim 1, additionally comprising a heater means connected in the circulating system.

3. A device as described in claim 1, additionally comprising a heater means disposed in the filter bypass circuit.

4. A device as described in claim 1, wherein said motor includes a dual stator winding which may be selectively energized by said motor speed selecting means to provide different operating speeds.

5. A device as described in claim 1, wherein the motor is close-coupled to the pump, thereby forming an integral compact unit.

6. A device as described in claim 1, wherein the injecting means comprise a plurality of nozzles disposed about the periphery of the water-retaining means.

7. A device as described in claim 1, wherein the water injecting means comprise a plurality of nozzles disposed at one side of the water-retaining means and the outlet is disposed on an opposite side so that a current of water from one side to the other is established in the water retaining means.

8. A method of operating a hydrotherapy device to provide efficient operation and maintenance of water clarity and purity, said device including a water circulating loop having a two-speed motor close-coupled to a centrifugal liquid pump, a filter, a filter bypass circuit that may be selectively actuated, and water injecting means comprising the steps of:

energizing the motor at a low energy saving speed to achieve a low water circulation rate with the filter connected in the circulating loop to thereby maintain water clarity during periods of non-use;

energizing the motor at a higher speed during periods of use to achieve a higher water circulation rate and to provide a higher water velocity out of the water injecting means; and selectively bypassing the water around the filter during periods of use to thereby cause the water circulation rate to further increase to a yet higher circulation rate for improved therapeutic action.

9. A method of operating a hydrotherapy water circulation system to obtain maximum efficiency and operating effectiveness, comprising the steps of:

establishing a first system head curve for the circulation system by connecting a filter in the system;

selectively operating at a point on the first system head curve to establish a low water circulation rate sufficient to maintain water clarity during periods of non-use;

selectively establishing a second system head curve by bypassing the filter, whereby a higher water circulation rate is experienced; and selectively changing the operating point on the second system head curve to establish a still higher water circulation rate and water velocity thereby improving the therapeutic effect.

10. A method of operating a hydrotherapy device having a water circulation system and filter to achieve maximum operational efficiency, the method comprising the steps of:

establishing a first system head characteristic curve by connecting the filter into the circulation system;

energizing a pump drive motor at a first predetermined low power consuming speed to operate at a point on the first system head characteristic curve so that a low water circulation rate is established sufficient to maintain water clarity during periods of non-use;

establishing a second system head characteristic curve by bypassing the filter whereby a higher water circulation rate is experienced; and energizing the pump drive motor at a second predetermined high power consuming speed to change operating points on the second system head characteristic curve so that a still higher water circulation rate is established and greater water velocity that provides an improved therapeutic effect.

11. A method of operating a hydrotherapy device to provide maximum efficiency and operating effectiveness while maintaining water clarity and purity, said device including means for retaining a body of water, a water circulating loop connected to a drain in said water retaining means, said water circulating loop including a two-speed motor close-coupled to a centrifugal liquid pump, a filter, means for selectively bypassing said filter and means for injecting water into the body of water, the method comprising the steps of:

connecting the filter into the water circulating loop;

energizing the motor at a low power conserving speed to achieve a low water circulation rate through the circulating loop sufficient to maintain water clarity during periods of non-use;

bypassing the filter to increase the water circulation rate; and energizing the motor at a high speed to achieve a still higher water circulation rate and higher water velocity out of the water injecting means that results in improved therapeutic action.

* * * * *